United States Patent [19]

Shekter

[11] 4,408,779

[45] Oct. 11, 1983

[54] SKI AND A SKI BINDING

[76] Inventor: Robert J. Shekter, 912 Lea Dr., San Rafael, Calif. 94903

[21] Appl. No.: 237,087

[22] Filed: Feb. 23, 1981

[30] Foreign Application Priority Data

Feb. 27, 1980 [GB] United Kingdom ..... 8006570

[51] Int. Cl.[3] ..... A63C 9/00

[52] U.S. Cl. ..... 280/607; 280/618; 280/633

[58] Field of Search ..... 280/607, 617, 618, 633, 280/636; 49/465

[56] References Cited

U.S. PATENT DOCUMENTS

| | | | |
|---|---|---|---|
| 3,852,896 | 12/1974 | Pyzel et al. | 280/617 |
| 4,141,570 | 2/1979 | Sudmeier | 280/618 X |

FOREIGN PATENT DOCUMENTS

| | | |
|---|---|---|
| 5155173 | 8/1975 | Australia . |
| 288929 | 4/1971 | Austria . |
| 501555 | 6/1930 | Fed. Rep. of Germany . |
| 1898852 | 8/1965 | Fed. Rep. of Germany . |
| 2613387 | 10/1977 | Fed. Rep. of Germany . |
| 2743667 | 4/1978 | Fed. Rep. of Germany . |
| 2806403 | 8/1978 | Fed. Rep. of Germany . |
| 2922269 | 1/1980 | Fed. Rep. of Germany . |
| 7905336 | 8/1980 | Fed. Rep. of Germany . |
| 2212158 | 7/1974 | France . |
| 2350119 | 12/1977 | France . |
| 514346 | 12/1971 | Switzerland . |

*Primary Examiner*—Joseph F. Peters, Jr.
*Assistant Examiner*—Michael Mar
*Attorney, Agent, or Firm*—Roylance, Abrams, Berdo & Farley

[57] ABSTRACT

A ski has a ski binding detachably mounted. The ski binding, which includes the usual safety release system, includes a binding plate which is securable to the ski. In some embodiments, the binding plate engages a ski plate which is fixed (e.g. by screws) to the ski, the two plates having interengageable male/female edge surfaces and said interengagement is maintained by the agency of separately operated means (e.g. set screw, cam, blocking device). In another embodiment, the ski plate is integral with the ski and, in yet another embodiment, the ski plate is integral with the binding plate. In the last-mentioned embodiment, the ski plate is accommodated in a complementary cavity in the ski.

14 Claims, 18 Drawing Figures

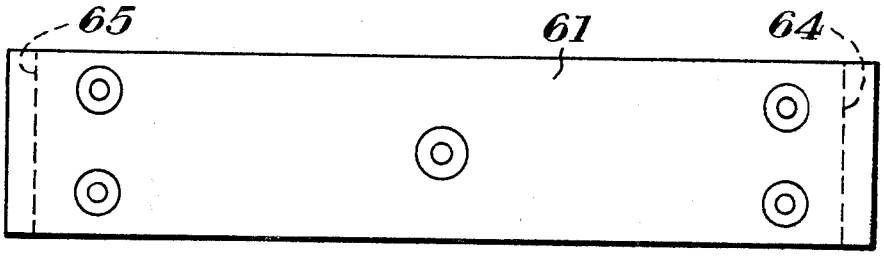
Fig. 13
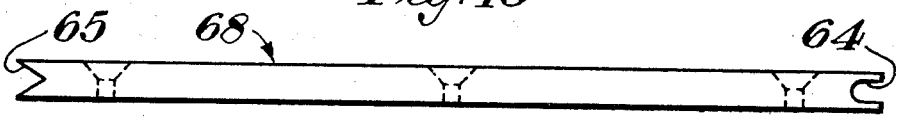
Fig. 14
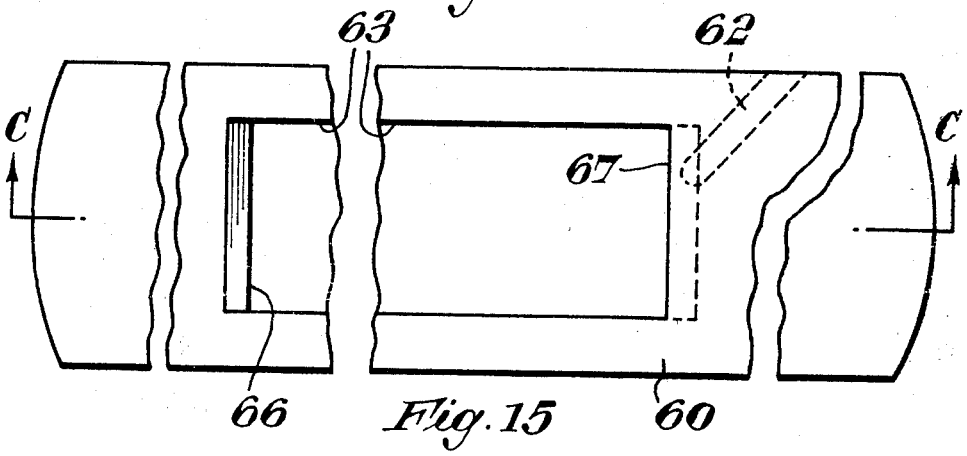
Fig. 15
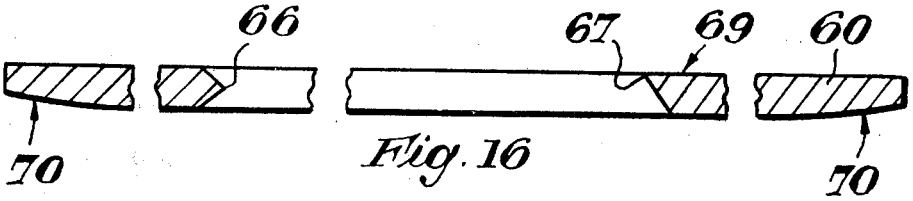
Fig. 16
Fig. 17
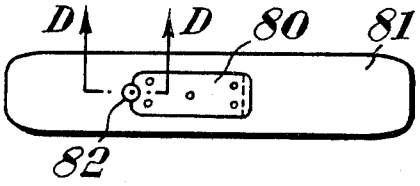
Fig. 18
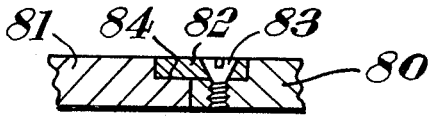

SKI AND A SKI BINDING

This invention relates to a ski binding and to skis adapted to be used therewith.

At many skiing resorts, skis may be hired from a proprietor who owns the skis. The proprietor must carry a large enough stock of skis to enable him to satisfy the demand and this entails the provision of quite a large range of sizes of skis. Thus, by way of example only, in order for the proprietor to be able to hire out one hundred pairs of skis for a week-end, he must stock approximately four hundred pairs of skis of various lengths in order to be able to satisfy customers who will be of different heights and weights and who will also have different skiing abilities. Skiers, or at least some of them, have preferences for certain bindings which will in all probability be identifiable by trade marks and the proprietor will need to try to stock a large number of the various brands of bindings to suit the possible demands of his customers; not only are ski bindings of high quality very expensive (they can cost as much as the skis) but also the proprietor may be faced with the need to change the pair of bindings already on a pair of skis for a pair of another brand of ski bindings in order to satisfy a particular customer. The cost of stocking large numbers of different brands of ski bindings involves an undesirably large capital outlay for the proprietor, and the possible need for replacement of mounted ski bindings by others takes time.

The principal object of the present invention is to overcome the disadvantages explained above in a simple and cheap manner.

Accordingly, the present invention consists in an assembly comprising a ski and a ski binding detachably mounted thereon, said ski having means positively engaged by a binding plate which forms part of the ski binding which includes a safety release system operable to release a ski boot when predetermined stress conditions are reached.

In a first embodiment of said assembly, said means may be a ski plate which is secured firmly to the ski and which includes a first portion movable relatively to a second portion against the influence of a spring or springs in order to permit the binding plate to be connected to the ski plate by a snap action, movement of said first portion relatively to said second portion subsequently to said connection having been made being prevented by a blocking device which can be rendered inoperable when such movement is required. Said blocking device may take the form of a plug which is inserted into a gap between said first and said second portions in order to prevent said first portion being moved towards said second portion for the purpose of disconnecting the connected plates.

In said first embodiment of said assembly, said ski plate is preferably of rectangular plan configuration and said binding plate has an aperture therein which is capable of accommodating said ski plate, opposite ends of the ski plate and correspondingly opposite parts of the binding plate being shaped to provide mating male and female connections which are maintained by the insertion of said blocking device.

In a second embodiment of said assembly, said means may be a ski plate which is secured firmly to the ski, the ski plate being accommodated within an aperture in the binding plate and corresponding edge surfaces (one on said ski plate and the other on said binding plate) being shaped to provide a mating male and female connection between said plates, said connection being positively maintained by a screwed or screw-operated device which is carried by said binding plate and which engages another edge surface of said ski plate opposite to the first-mentioned edge surface thereof. The device will preferably be a set screw which engages a notch or groove in said other edge surface of said ski plate.

In a third embodiment of said assembly, said means may be a ski plate which is secured firmly to the ski and which accommodates within its thickness a cam which is movable angularly about an eccentric axis of rotation which extends in a direction parallel to that in which the ski plate thickness is measured, the ski plate being accommodated within an aperture in the binding plate and corresponding edge surfaces of said ski and binding plates being shaped to provide mating male and female connection between said plates, said connection being positively maintained by appropriate angular movement of said cam about its eccentric axis. Preferably, a protuberance on said binding plate engages a notch in said cam to maintain the locking action of said cam.

In a fourth embodiment of said assembly, said means may be a boss which is integral with the ski (for example, moulded at the same time as the remainder of the ski is moulded) and which is provided with undercuts at its opposite ends, the binding plate being provided with an aperture for the accommodation of said boss, the aperture being bounded at one end by an edge surface which is complementary to the undercut at the respective end of the boss, the binding plate also being provided with means operable to maintain positive interengagement between the respective undercut of the boss and the complementary edge surface of the binding plate.

In a fifth embodiment of said assembly, said means may be an elongate cavity formed in the ski and interrupting the top surface thereof, said cavity being bounded by four walls which include two opposite end walls each of which slopes away from a transverse plane containing the mid-length point of the cavity in order to provide an undercut, the binding plate having an elongate boss which is integral therewith or attached thereto and which is accommodated in said cavity, said boss having four walls of which one is so shaped as to be complementary to the undercut of one of said end walls of the cavity, said binding plate also having means operable to maintain positive interengagement between said undercut of said one end wall and the complementary shaped wall of the binding plate.

The means operable to maintain said positive interengagement referred to in each of the two preceding paragraphs may be constituted by at least one set screw rotatable in a threaded passageway so as to cause the binding plate to be moved relatively to the ski in a direction such as will maintain said interengagement.

The present invention will now be more particularly described with reference to the accompanying diagrammatic drawings, in which:

FIGS. 13 and 14 are plan and side views of another ski plate;

FIGS. 15 and 16 are a plan view and a longitudinal section of a binding plate for use with the ski plate of FIGS. 13 and 14, the section being taken on the line C—C in FIG. 15;

FIG. 17 illustrates an interengaged ski plate and binding plate, the binding plate being shown without its toe and heel bindings; and FIG. 18 is a section on the line D—D in FIG. 17 and is drawn on a larger scale than FIG. 17.

Figure 1:
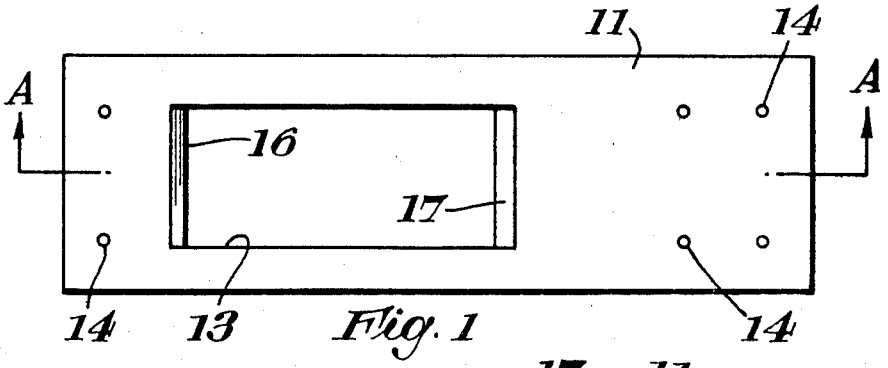
FIGS. 1 and 2 illustrate a binding plate, FIG. 2 being a longitudinal section taken on the line A—A in FIG. 1.
Figure 2:
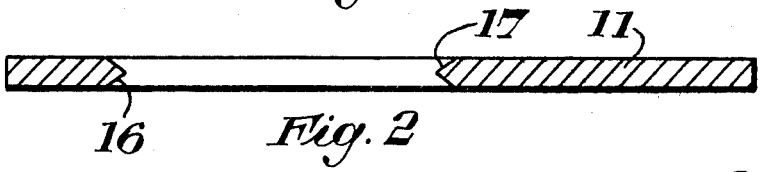
Figure 5:
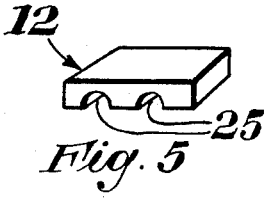
FIG. 5 illustrates a blocking device in perspective.
Figure 3:
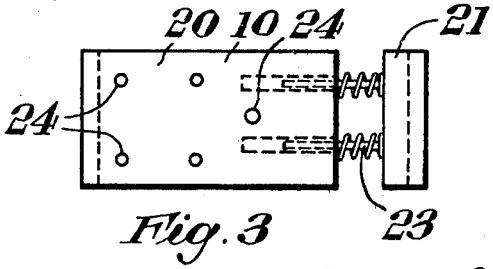
FIGS. 3 and 4 illustrate side and plan views of a ski plate for use with the binding plate shown in FIGS. 1 and 2.

Referring firstly to FIGS. 1 to 5, there are illustrated therein a ski plate 10, a binding plate 11 and a blocking device 12. The binding plate 11 has an aperture 13 therein and a number of holes 14 for fixing screws used to secure the binding plate and the chosen ski binding to one another, the fixing screws are not shown in FIGS. 1 and 2 but are like the fixing screws 15 shown in FIG. 12. The short parallel sides of the aperture 13 are defined by plate portions having edges which are V-shaped in cross-section and which are indicated by the reference numerals 16, 17. The ski plate 10 has V-notched ends 18, 19 for engagement with the V-shaped edges 16,17, respectively, and comprises two portions 20, 21 which are movable relatively to one another against springs 22 on guide rods 23. The ski plate 10 is secured to a ski by fixing screws (not shown in FIGS. 3 and 4 but similar to the fixing screws 15 shown in FIG. 12) extending through apertures 24, said apertures being provided only in the portion 20 because the portion 21 has to be capable of being moved relatively to the portion 20. The blocking device 21 is, in one face thereof, provided with two parallel channels 25 so that the springs/guide rods 22, 23 can be accommodated therein when the blocking device is dropped into the space between the portions 20, 21.

In order to mount the binding plate 11 (together with its attached toe binding and heel binding) on a ski, the V-shaped plate edges 16, 17 are engaged in the V-notched ends 18, 19 and thereafter the blocking device 12 is dropped into position to prevent unintended disengagement. The blocking device 12 can be made, for example, from a plastics material and, once in position between the portions 20 and 21, the wearer's foot will prevent it from coming out accidentally.

Figure 6:
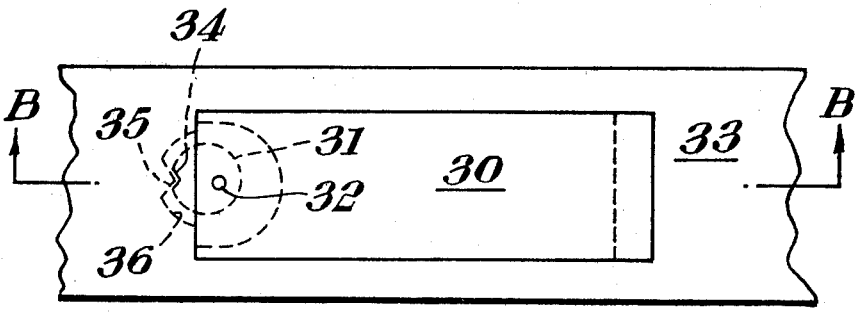
FIGS. 6 and 7 illustrate plan and longitudinal section views of a ski plate and a binding connected to one another by an alternative system, the section being taken on the line B—B in FIG. 6.
Figure 7:
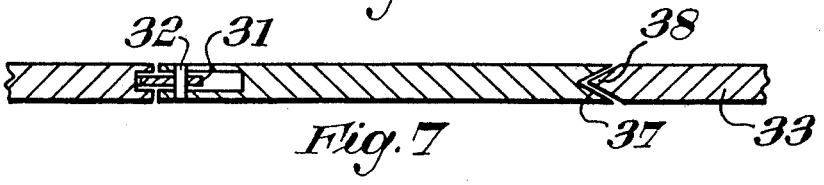

FIGS. 6 and 7 illustrate a ski plate 30 having at one end thereof an integral cam 31 which is rotatable about an eccentric axis 32 which is normal to the upper ski plate surface. Rotation of the cam 31 through 180° from a datum position thereof ensures firm connection of the binding plate 33 to the ski plate 30 because, as illustrated in FIGS. 6 and 7, a notch 34 in the periphery of the cam 31 engages a protuberance 35 on said plate 33, which protuberance extends into a complementary slot 36 formed in said binding plate 33. At the other end thereof, the ski plate 30 has a V-shaped notch 37 into which extends a V-section edge 38 of the binding plate 33. It will be appreciated that the coacting protuberance 35 and notch 34 act as a "click stop" which maintains the cam 31 in its operative position.

Figure 8:
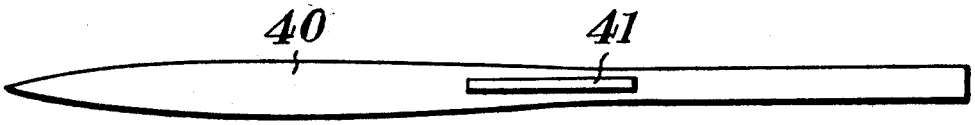
FIGS. 8 and 9 are plan and side views of a moulded ski having an integral ski plate of "positive" kind.
Figure 9:
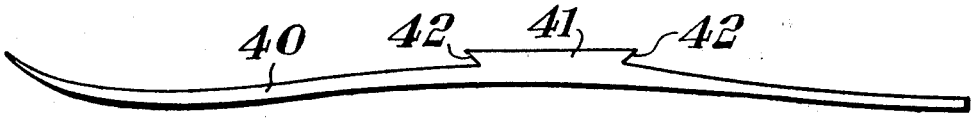
Figure 10:
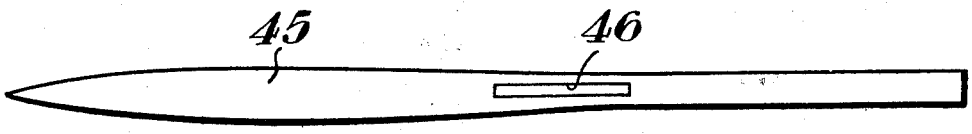
FIGS. 10 and 11 are plan and side views of a moulded ski having an integral ski "plate" of negative kind (namely, a cavity)
Figure 11:
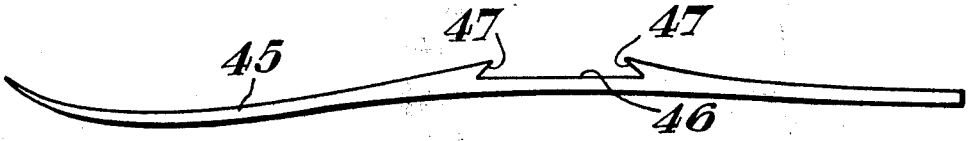
Figure 12:
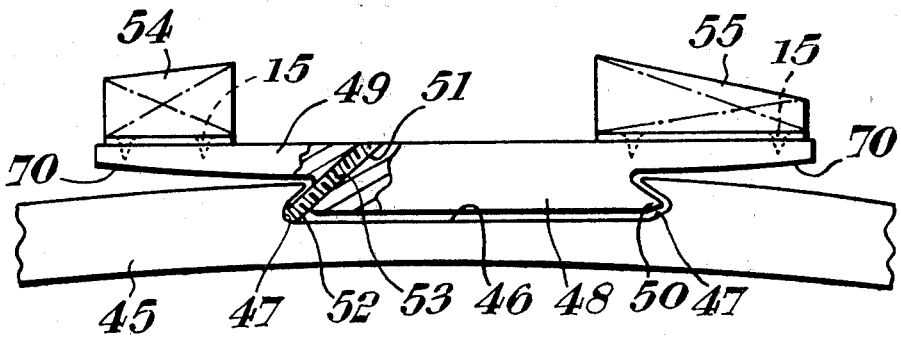
FIG. 12 illustrates a portion of a ski according to FIGS. 10 and 11, drawn on a larger scale than those Figures, and a binding plate complementary thereto and securely mounted thereon.

FIGS. 8 to 12 illustrate further embodiments. FIGS. 8 and 9 show two views of a complete ski 40 having a ski plate 41 which is integral (for example, by moulding) with the ski; such a ski plate could not become detached from the ski under any normal conditions and the junction of said ski plate 41 with the remainder of the ski provides forward and rearward undercuts 42. In FIGS. 10 and 11, there is illustrated a complete ski 45 having a cavity 46 therein for the accommodation of a ski plate portion of a binding plate which will be described below with reference to FIG. 12. The cavity 46 is so shaped as to provide forward and rearward undercuts 47. Referring to FIG. 12, a ski plate 48 portion and a binding plate 49 are integral with one another (for example, as a result of being moulded in that form) and cannot become detached from one another under any normal conditions. The ski plate 48 has a V-section edge 50 which is, in use, inserted into the rear undercut 47 of the cavity. Moreover, there is an angled tapped passageway 51 extending downwardly and forwardly through the binding plate 49 and ski plate 48 and a threaded bolt or screw 52, having an appropriately formed top end 53, is located in said passageway. Said top end 53 can either be formed with a diametral slot for engagement of the screw 52 by a screwdriver blade or be formed with a hexagonal recess for engagement of the screw by an Allen key. By using the screw-driver or key, the screw 52 can be caused to move from a position in which the screw is located wholly within the passageway 51 to a position in which the distal end portion of the screw projects from the forward end of the ski plate into the forward undercut 47. Thus, the ski 45 and the combined ski plate/binding plate are securely connected together.

The binding plate 49 is illustrated as carrying a toe binding 54 and a heel binding 55, said toe and heel bindings being fixed to the respective ends of the binding plate by fixing screws 15. The manner in which the bindings are made in order to facilitate such fixing (for example, by the provision of flanges or lugs on the toe/heel binding which are appropriately apertured to permit the fixing screws 15 to extend therethrough into the binding plate 49) is well-known and does not form part of the invention; for this reason the illustration of the fixing is simplified. Furthermore, the toe and heel bindings 54, 55 incorporate a safety release system operable to release a ski boot when predetermined stress conditions are reached but said system is not illustrated because such systems are well-known and are not part of the present invention. The remarks made in this paragraph about the embodiments of FIGS. 8 to 12 apply to the other embodiments.

It will be appreciated, of course, that an arrangement which is the converse of that shown in FIG. 12 will be needed for the ski 40 and integral ski plate 41 of FIGS. 8 and 9. Thus, the binding plate (not illustrated in FIGS. 8 and 9) for use with the ski 40 would need to be somewhat of the form of that described below with reference to FIGS. 13 to 16; one end of the aperture in the binding plate would need to be provided with a chisel-ended edge which would extend into the front or rear undercut 42 and the binding plate would need to be provided with a tapped passageway and threaded screw (similar to 51, 52, 53 in FIG. 12) at the other end of the aperture and the screw could be operated to project into the other undercut 42.

FIGS. 13 to 16 can be described very briefly and illustrate a preferred form of a binding plate 60 adapted to coact with a ski plate 61. The binding plate 60 includes an angled passageway and screw jointly indicated by the reference numeral 62. Said passageway and screw 62 are similar to the passageway 51 and screw 52, 53 of FIG. 12 but the passageway is accommodated within the thickness of the plate 60 and is in communication at its inboard end with an aperture 63 in said plate 60. The ski plate 61 is provided with a notch 64 of semi-cylindrical form in one end thereof and the other end of the ski plate has a V-notch 65 which is adapted to coact with a V-shaped edge portion 66 at one end of the aperture 63 of the binding plate. A chisel-ended edge portion 67 is given to the binding plate 60 at the other end of the aperture 63, preferably having a slope of 45°, this chisel-end shape being necessary in order to enable the edge portion 66 to be progressively slid into the complementary notch 65. When the upper surface 68 of the ski plate 61 is flush with the upper surface 69 of the binding plate, the screw 62 in the passageway is operated to cause its distal end to project out of the binding plate into the notch 64 in the ski plate.

The radiused end portions, indicated by the reference numeral 70 in FIG. 16, of the binding plate 60 facilitate the inevitable flexing of the ski when the ski is being used. A similar radiusing of the end portions of the binding plate 49 in FIG. 12 is also indicated by the same reference numeral 70.

Referring lastly to FIGS. 17 and 18, there are illustrated therein a ski plate 80 and a binding plate 81. The ski plate 80 is fixed to a ski (not illustrated) in the usual manner (see for example FIGS. 4, 13 and 14) by fixing screws and the binding plate 81 carries toe and heel bindings (not shown) which are fixed thereto in known manner. The ski plate 80 is accommodated in the binding plate 81 in an aperture whose shape is complementary to that of said plate 80. The two plates 80,81 have rounded corners instead of 90° corners; these rounded corners have been found to be a desirable feature if it is desired to stamp said plates out of sheet metal. A tab or washer 82 is secured to the ski plate 80 by a screw 83 in such a manner that a part of said washer projects beyond the periphery of said plate 80. The binding plate 81 is provided with a cutout portion or ledge 84 whose shape and depth exactly matches that of the projecting part of the washer. The coaction of the ledge 84 and projecting part of the washer 82 keeps the binding plate firmly on the ski. If desired, of course, the arrangement 82, 83, 84 may be duplicated, for example, by providing another such arrangement at the other end of the ski plate 80.

Stamping of the parts from metal has been mentioned in the preceding paragraph but it is to be noted that it is not only contemplated to employ metal (for example, aluminium) for the ski and binding plates; it is alternatively contemplated to use glass reinforced plastics materials or even a material which incorporates carbon fibres. The latter material, which is already in use in ski construction, contains carbon fibres which are impregnated with a liquid epoxy resin; when heat and pressure are applied, the still liquid resin is forced into all of the cavities and ultimately sets.

Figure 4:
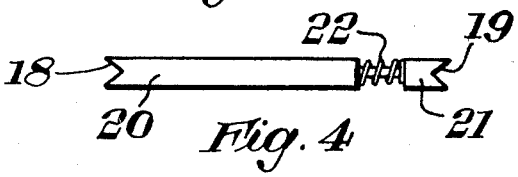

The ski plate in each embodiment described above with reference to the drawings has a screw hole which is located exactly at the centre of the plate (see, for example, FIGS. 4, 13, 14). This centre screw hole is brought into exact register with the centre mark made by the ski manufacturer on the ski.

All fixing screws by means of which the ski plates are secured to the skis are desirably set in epoxy resin.

The moulded skis illustrated in FIGS. 8 to 12 could be made from glass reinforced plastics material or from carbon fibre reinforced epoxy resin.

End of plate 80 (FIG. 17) remote from tab 82 has V-notch therein and plate 81 has complementary V-section edge. Tab 82 could be elongate and pivotal into and out of its projecting position to engage ledge 84.

I claim:

1. An assembly for detachably mounting a ski binding with a safety release system on a ski, which comprises a ski plate having means for fixing said ski plate to a ski and having first and second portions coupled for relative movement between locking and release positions;

a binding plate having means for mounting a ski binding thereon and an aperture extending completely and vertically through said binding plate, said aperture having opposite ends which engage opposite ends of said ski plate with mating male and female connections when said portions are in said locking position; and blocking means for releasably engaging and preventing relative movement of said first and second portions from said locking position.

2. An assembly according to claim 1 wherein said first and second portions are spring biased toward said locking position.

3. An assembly according to claim 1 wherein said first and second portions are separated by a gap; and wherein said locking means comprises a plug releasably received in said gap preventing movement of said first portion toward said second portion.

4. An assembly according to claim 1 wherein said first and second portions are spring biased away from each other toward said locking position and are separated by a gap; and wherein said locking means comprises a plug releasably received in said gap preventing movement of said first portion toward said second portion.

5. An assembly for detachably mounting a ski binding with a safety release system on a ski, which comprises a ski plate having means for fixedly mounting said ski plate on a ski and having first and second longitudinal ends;

a binding plate having means for mounting a ski binding thereon and having an aperture extending vertically completely through said binding plate for receiving said ski plate, said aperture having opposite first and second longitudinal ends positioned adjacent said ski plate first and second ends, respectively, said first ends being complementarily shaped forming a mating male and female connection therebetween; and coupling means movably carried by one of said plates adjacent said second end thereof for engaging said second end of the other plate and positively engaging said ski plate and said binding plate.

6. An assembly according to claim 5 wherein said coupling means comprises screw means threadably mounted in said binding plate.

7. An assembly according to claim 6 wherein said screw means comprises a set screw in a threaded passageway oriented at an acute angle relative to longitudinal axes of said plates; and said ski plate second end has a notch engaging said set screw.

8. An assembly according to claim 5 wherein said coupling means comprises a cam mounted within the thickness of said one plate for eccentric rotation about an axis perpendicular to said one plate.

9. An assembly according to claim 8 wherein said cam is rotatably mounted in said ski plate.

10. An assembly according to claim 9 wherein said binding plate second end has a protuberance and said cam has a notch in the periphery thereof, said protuberance engaging said notch to angularly set said cam in a locking position.

11. An assembly according to claim 5 wherein said ski plate comprises an integral boss on the ski, said boss having undercuts in said ski plate first and second ends.

12. An assembly according to claim 11 wherein said couplings means comprises a set screw mounted in a threaded passageway in said binding plate.

13. An assembly for detachably mounting a ski binding with a safety release system on a ski, which comprises a ski plate having means for fixedly mounting said ski plate on a ski and having first and second ends;

a binding plate having means for mounting a ski binding thereon and having an aperture receiving said ski plate, said aperture having opposite first and second ends positioned adjacent said ski plate first and second ends, respectively, said first ends being complementarily shaped forming a mating male and female connection therebetween; and coupling means movably carried by one of said plates adjacent said second end thereof for engaging said second end of the other plate and positively engaging said ski plate and said binding plate, said coupling means including a tab coupled to and projecting laterally from the periphery of said ski plate and a cut-away ledge formed in said binding plate and communicating with said aperture, a portion of said tab being received on said ledge to positively engage said ski plate and binding plate.

14. An assembly according to claim 13 wherein said tab is coupled to said ski plate by a screw.

* * * * *